US008979509B2

(12) United States Patent
Matsumoto et al.

(10) Patent No.: US 8,979,509 B2
(45) Date of Patent: Mar. 17, 2015

(54) SCREW COMPRESSOR HAVING REVERSE ROTATION PROTECTION

(75) Inventors: Norio Matsumoto, Osaka (JP); Hiromichi Ueno, Osaka (JP); Shigeharu Shikano, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 299 days.

(21) Appl. No.: 13/498,881

(22) PCT Filed: Sep. 30, 2010

(86) PCT No.: PCT/JP2010/005901

§ 371 (c)(1),
(2), (4) Date: Mar. 28, 2012

(87) PCT Pub. No.: WO2011/040039

PCT Pub. Date: Apr. 7, 2011

(65) Prior Publication Data

US 2012/0183418 A1 Jul. 19, 2012

(30) Foreign Application Priority Data

Sep. 30, 2009 (JP) ..... 2009-228321

(51) Int. Cl.
*F04B 17/00* (2006.01)
*F04B 49/00* (2006.01)
(Continued)

(52) U.S. Cl.
CPC ..... *F04C 18/52* (2013.01); *F04C 18/086* (2013.01); *F04C 28/26* (2013.01); *F04C 28/28* (2013.01); *F04C 29/04* (2013.01); *F04C 2270/86* (2013.01)
USPC ..... 417/410.4; 417/302; 417/411; 417/440; 417/439; 417/310; 417/505

(58) Field of Classification Search
CPC ..... F04C 18/02; F04C 18/08; F04C 18/082; F04C 28/06; F04C 28/24; F04C 28/26; F04C 29/124; F04C 29/126; F04C 2270/72; F04C 18/0207; F04C 18/023; F04C 2240/30; F04C 2270/025
USPC ..... 417/282, 302, 411, 410.3, 410.4, 440, 417/439, 505, 307, 310, 293
See application file for complete search history.

(56) References Cited

U.S. PATENT DOCUMENTS 4,470,767 A * 9/1984 Frings et al. ..... 417/310
4,747,755 A * 5/1988 Ohtsuki et al. ..... 417/282
(Continued)

FOREIGN PATENT DOCUMENTS

JP 56-83592 A 7/1981
JP 61-184362 A 8/1986
(Continued)

OTHER PUBLICATIONS

International Search Report of corresponding PCT Application No. PCT/JP2010/005901.

*Primary Examiner* — Bryan Lettman
*Assistant Examiner* — Timothy P Solak
(74) *Attorney, Agent, or Firm* — Global IP Counselors

(57) ABSTRACT

A screw compressor includes a casing and a compression mechanism accommodated in the casing. The compression mechanism has a screw rotor, a gate rotor and a communication mechanism. The gate rotor has a flat plate shape. A rotational axis of gate rotor is orthogonal to a rotational axis of the screw rotor. The communication mechanism is arranged to communicate a high pressure space and a low pressure space in the casing.

5 Claims, 12 Drawing Sheets

(51) Int. Cl.

| | |
|---|---|
| ***F04B 39/00*** | (2006.01) |
| ***F04B 23/00*** | (2006.01) |
| ***F04B 7/00*** | (2006.01) |
| ***F04C 18/52*** | (2006.01) |
| ***F04C 18/08*** | (2006.01) |
| ***F04C 28/26*** | (2006.01) |
| ***F04C 28/28*** | (2006.01) |
| ***F04C 29/04*** | (2006.01) |

(56) References Cited

U.S. PATENT DOCUMENTS

| | | | | |
|---|---|---|---|---|
| 5,127,386 | A * | 7/1992 | Sowards | 123/564 |
| 5,167,491 | A | 12/1992 | Keller, Jr. et al. | |
| 6,042,344 | A * | 3/2000 | Lifson | 417/310 |
| 6,123,517 | A * | 9/2000 | Brooke et al. | 417/299 |
| 2002/0113201 | A1 * | 8/2002 | McAllister et al. | 250/231.13 |
| 2008/0145725 | A1 * | 6/2008 | Nau et al. | 429/19 |

FOREIGN PATENT DOCUMENTS

| | | | |
|---|---|---|---|
| JP | 62-223361 | A | 1/1987 |
| JP | 5-223361 | A | 8/1993 |
| JP | 5-332265 | A | 12/1993 |
| JP | 6-42474 | A | 2/1994 |
| JP | 2004-324601 | A | 11/2004 |
| JP | 2009-174525 | A | 8/2009 |

* cited by examiner (A)

(B)

SCREW COMPRESSOR HAVING REVERSE ROTATION PROTECTION

CROSS-REFERENCE TO RELATED APPLICATIONS

This U.S. National stage application claims priority under 35 U.S.C. §119(a) to Japanese Patent Application No. 2009-228321, filed in Japan on Sep. 30, 2009, the entire contents of which are hereby incorporated herein by reference.

TECHNICAL FIELD

The present invention relates to screw compressors, and particularly relates to measures for preventing damage and breakage of gate rotors.

BACKGROUND ART

Single screw compressors used as compressors for refrigeration and air conditioning have been known. For example, the single screw compressor shown in Japanese Patent Publication No. 2004-324601 includes a screw rotor having a plurality of helical grooves on the outer peripheral surface thereof, and two gate rotors each of which is in the shape of a flat plate and having a plurality of teeth. The two gate rotors are arranged such that the axis of each of the gate rotors is orthogonal to the axis of the screw rotor, and are placed symmetrically with respect to the screw rotor. Further, two compression chambers are formed by being surrounded by an inner peripheral surface of a cylindrical wall, a tooth groove of the screw rotor, and the teeth of the gate rotors.

In this single screw compressor, the teeth of the gate rotors move along the tooth groove of the screw rotor as the screw rotor rotates, and the operation in which the capacity of each of the compression chambers is increased and decreased is repeated. During a period when the capacity of the compressor is increased, a refrigerant is sucked in the compression chamber, and when the capacity of the compression chamber starts to decrease, the sucked refrigerant is compressed. When the tooth groove (i.e., the compression chamber) communicates with an outlet, the compressed high-pressure refrigerant is discharged from the compression chamber.

SUMMARY

Technical Problem

As shown in FIG. 11, the conventional single screw compressor rotates at a constant 110 rotational frequency of about 3600 rpm in a normal operation. In this single screw compressor, as shown in FIG. 12, the low pressure space and the high pressure space communicate with each other via the compression chamber formed by the screw rotor and the gate rotor (a). Thus, in the event of sudden halt of the single screw compressor, the screw rotor may rotate in a reverse direction due to a pressure difference of the refrigerant. In this case, the rotational frequency of the screw rotor may reach to 7000 rpm, and in the compression chamber, the pressure of the refrigerant on the compression space of the gate rotor (a) (i.e., the downstream side of the refrigerant) falls, whereas the pressure of the refrigerant on the non-compression space (i.e., the upstream side of the refrigerant) increases. Consequently, as shown in FIG. 13, the gate rotor support (b) on the back surface of the gate rotor (a) may be damaged or broken by being bent to the compression space (i.e., the downstream side) of the compression chamber due to the pressure of the refrigerant in the non-compression space (i.e., the upstream side of the refrigerant) of the compression chamber.

The present invention was made in view of the above problems, and it is an objective of the invention to prevent damage and breakage of a gate rotor of a screw compressor.

Solution to the Problem

In a screw compressor of the present invention, a pressure difference in the casing (10) is reduced by allowing the high pressure space and the low pressure space in the casing (10) to communicate with each other.

The first aspect of the present invention is intended for a screw compressor which includes a casing (10), and a compression mechanism (20) accommodated in the casing (10) and having a screw rotor (30) and a gate rotor (40) which is in the shape of a flat plate and whose axis is orthogonal to an axis of the screw rotor (30). The compression mechanism (20) includes a communication mechanism (50) which communicates a high pressure space and a low pressure space in the casing (10).

According to the first aspect of the present invention, a compression chamber is formed in the compression mechanism (20) between the screw rotor (30) and the gate rotor (40). The capacity of the compression chamber is increased and decreased as the screw rotor (30) is rotated. Fluid is compressed by the increase and decrease in the capacity of the compression chamber.

In the case where a pressure difference of the fluid in the casing (10) is increased, and the screw rotor (30), etc., of the compression mechanism (20) is rotated in a reverse direction, the communication mechanism (50) makes the high pressure fluid side and the low pressure fluid side in the casing (10) communicate with each other. When the high pressure space and the low pressure space in the casing (10) communicate with each other, the fluid in the high pressure space flows to the low pressure space, which results in a reduction in pressure difference of the fluid in the casing (10). With this structure, it is possible to prevent the screw rotor (30) and the gate rotor (40) of the compression mechanism (20) from being rotated in a reverse direction.

The second aspect of the present invention is that iii the first aspect of the present invention, the casing (10) includes a low pressure chamber (12) in which a low pressure fluid to be suctioned into the compression mechanism (20) flows, and a high pressure chamber (11) in which a fluid compressed by the compression mechanism (20) flows, and the communication mechanism (50) includes a communication passage (52, 62) connecting the high pressure chamber (11) and the low pressure chamber (12), and a valve mechanism (53, 63) for adjusting an amount of a fluid flowing in the communication passage (52, 62).

According to the second aspect of the present invention, in the case where a pressure difference of the fluid in the casing (10) is increased, and the screw rotor (30), etc., of the compression mechanism (20) is rotated in a reverse direction, the communication mechanism (50) opens the valve mechanism (53, 63). When the valve mechanism (53, 63) is open, the fluid flowing in the high pressure chamber (11) of the casing (10) passes through the communication passage (52, 62) and flows to the low pressure chamber (12), which results in a reduction in a pressure difference of the fluid in the casing (10). With this structure, it is possible to prevent the screw rotor (30) and the gate rotor (40) of the compression mechanism (20) from being rotated in a reverse direction.

The third aspect of the present invention is that in the second aspect of the present invention, the communication passage (52) is provided in the casing (10).

According to the third aspect of the present invention, in the case where a pressure difference of the fluid in the casing (10) is increased, and the screw rotor (30), etc., of the compression mechanism (20) is rotated in a reverse direction, the communication mechanism (50) opens the valve mechanism (53). When the valve mechanism (53) is open, the fluid flowing in the high pressure chamber (11) of the casing (10) passes through the communication passage (52) provided in the casing (10) and flows to the low pressure chamber, which results in a reduction in a pressure difference in the casing (10). With this structure, it is possible to prevent the screw rotor (30) and the gate rotor (40) of the compression mechanism (20) from being rotated in a reverse direction.

The fourth aspect of the present invention is that in the third aspect of the present invention, the casing (10) includes a cylinder member (25) surrounding the screw rotor (30), and a heating groove (26) formed in the cylinder member (25) and guiding the fluid in the high pressure chamber (11) to the cylinder member (25), and an end of the communication passage (52, 62) which is connected to the high pressure chamber (11) communicates with the heating groove (26).

According to the fourth aspect of the present invention, the temperature of the screw rotor (30) increases as the screw rotor (30) is rotated. The fluid flowing in the high pressure chamber (11) is supplied to the heating groove (26), and heats the cylinder member (25). Since the cylinder member (25) is heated, a temperature difference between the cylinder member (25) and the screw rotor (30) is reduced. If the temperature difference between the cylinder member (25) and the screw rotor (30) is reduced, the difference in degree of thermal expansion between the cylinder member (25) and the screw rotor (30) is reduced. Accordingly, it is possible to prevent the formation of space and the occurrence of interference between the cylinder member (25) and the screw rotor (30) due to the difference in degree of thermal expansion between the cylinder member (25) and the screw rotor (30).

Further, in the case where a pressure difference of the fluid in the casing (10) is increased, and the screw rotor (30), etc., of the compression mechanism (20) is rotated in a reverse direction, the communication mechanism (50) opens the valve mechanism (53). When the valve mechanism (53) is open, the fluid flowing in the high pressure chamber (11) of the casing (10) is supplied to the communication passage (52) through the heating groove (26). The fluid having passed through the communication passage (52, 62) flows to the low pressure chamber (12). With this structure, a pressure difference between the high pressure chamber (11) and the low pressure chamber (12) in the casing (10) is reduced. As a result, it is possible to prevent the screw rotor (30) and the gate rotor (40) of the compression mechanism (20) from being rotated in a reverse direction.

The fifth aspect of the present invention is that in any one of the second to fourth aspects of the present invention, the communication passage (62) is provided outside the casing (10).

According to the fifth aspect of the present invention, in the case where a pressure difference of the fluid in the casing (10) is increased, and the screw rotor (30), etc., of the compression mechanism (20) is rotated in a reverse direction, the communication mechanism (50) opens the valve mechanism (63). When the valve mechanism (63) is open, the fluid flowing in the high pressure chamber (11) of the casing (10) passes through the communication passage (62) provided outside the casing (10) and flows to the low pressure chamber, which results in a reduction in a pressure difference in the casing (10). With this structure, it is possible to prevent the screw rotor (30) and the gate rotor (40) of the compression mechanism (20) from being rotated in a reverse direction.

The sixth aspect of the present invention is that in any one of the second to fifth aspects of the present invention, the communication mechanism (50) includes a first valve controller (70) which opens the valve mechanism (53, 63) when the compression mechanism (20) stops.

According to the sixth aspect of the present invention, the second valve controller (70) closes the valve mechanism (53, 63) during operation of the compression mechanism (20), whereas the second valve controller (70) opens the valve mechanism (53, 63) when the compression mechanism (20) stops. When the valve mechanism (53, 63) is open, the fluid flowing in the high pressure chamber (11) of the casing (10) passes through the communication passage (52, 62) and flows to the low pressure chamber (12), which results in a reduction in a pressure difference of the fluid in the casing (10).

The seventh aspect of the present invention is that in any one of the second to sixth aspects of the present invention, the compression mechanism (20) includes a rotational direction detector (76) which detects a direction of rotation of the screw rotor (30) or the gate rotor (40), and the communication mechanism (50) includes a second valve controller (70) which opens the valve mechanism (53, 63) when the rotational direction detector (76) detects that the screw rotor (30) or the gate rotor (40) is rotated in a reverse direction.

According to the seventh aspect of the present invention, the rotational direction detector (76) detects the direction of rotation of the screw rotor (30) or the gate rotor (40). The second valve controller (70) opens the valve mechanism (53, 63) when the rotational direction detector (76) detects that the screw rotor (30) or the gate rotor (40) is rotated in a reverse direction. When the valve mechanism (53, 63) is open, the fluid flowing in the high pressure chamber (11) of the casing (10) passes through the communication passage (52, 62) and flows to the low pressure chamber (12), which results in a reduction in a pressure difference of the fluid in the casing (10).

The eighth aspect of the present invention is that the screw compressor in any one of the second the seventh aspects of the present invention includes a DC motor (81) which rotates the compression mechanism (20), an accumulator (82) which accumulates electric power regenerated by the DC motor (81), and a third valve controller (83) which operates the valve mechanism (53, 63) using the electric power accumulated in the accumulator (82).

According to the eighth aspect of the present invention, the compression mechanism (20) is rotated by the DC motor (81). For example, if the compression mechanism (20) suddenly stops due to a power failure, etc., the screw rotor (30) is rotated in a reverse direction due to a pressure difference of the refrigerant. The DC motor (81) is also rotated in a reverse direction as the screw rotor (30) is rotated in a reverse direction. Thus, the DC motor (81) functions as an electric generator, and the regenerated electric power is accumulated in the accumulator (82). The third valve controller (83) operates and opens the valve mechanism (53, 63) using the electric power in the accumulator (82). When the valve mechanism (53, 63) is open, the fluid flowing in the high pressure chamber) of the casing (10) passes through the communication passage (52, 62) and flows to the low pressure chamber (12), which results in a reduction in pressure difference of the fluid in the casing (10). With this structure, it is possible to prevent the screw rotor (30) and the gate rotor (40) of the compression mechanism (20) from being rotated in a reverse direction.

Advantages of the Invention

According to the first aspect of the present invention, the communication mechanism (50) connects between the high pressure fluid side and the low pressure fluid side in the casing (10). It is therefore possible to reduce a pressure difference in the casing (10). In the conventional screw compressor, in the event, for example, of sudden halt of the compression mechanism, the screw rotor and the gate rotor are rotated in a reverse direction due to the difference between pressures of the fluids in the high pressure space and the low pressure space of the casing, and the gate rotor is damaged. Even in such a case, the fluid in the high pressure space is made to flow into the low pressure space without flowing through the compression mechanism (20), thereby making it possible to reduce the pressure difference between the high pressure space and the low pressure space in the casing (110), and thus possible to reduce the screw rotor (30) and the gate rotor (40) from being rotated in a reverse direction. Accordingly, it is possible to prevent the pressure in the non-compression space of the compression mechanism (20) from being higher than the pressure of the fluid in the compression space with reliability. As a result, it is possible to prevent damage and breakage of the gate rotor (40) with reliability.

According to the second aspect of the present invention, the communication passage (52, 62) and the valve mechanism (53, 63) for adjusting an amount of fluid passing through the communication passage (52, 62) are provided. Thus, the fluid in the high pressure chamber (11) can flow into the low pressure chamber (12) without flowing through the compression mechanism (20). That is, in the conventional screw compressor, in the event, for example, of sudden halt of the compression mechanism, the screw rotor and the gate rotor are rotated in a reverse direction due to the difference between pressures of the fluids in the high pressure space and the low pressure space of the casing, and the gate rotor is damaged. Even in such a case, the fluid in the high pressure space is made to flow into the low pressure space without flowing through the compression mechanism (20), thereby making it possible to reduce the pressure difference between the high pressure space and the low pressure space in the casing (10), and thus possible to reduce the screw rotor (30) and the gate rotor (40) from being rotated in a reverse direction. Accordingly, it is possible to prevent the pressure in the non-compression space of the compression mechanism (20) from being higher than the pressure of the fluid in the compression space with reliability. As a result, it is possible to prevent damage and breakage of the gate rotor (40) with reliability.

According to the third aspect of the present invention, the communication passage (52) is provided inside the casing (10). Thus, the fluid in the high pressure chamber (11) can flow into the low pressure chamber (12) without providing a communication passage outside the casing (10) independently. Accordingly, the screw compressor can downsized compared to the structure in which a communication passage is provided outside the casing (10).

According to the fourth aspect of the present invention, the heating groove (26) is provided so that the fluid flowing in the high pressure chamber (11) can pass through the heating groove (26). Thus, the cylinder member (25) can be heated by the fluid flowing in the heating groove (26). Accordingly, the temperature difference between the cylinder member (25) and the screw rotor (30) can be reduced. That is, in the conventional screw compressor, a temperature difference between the screw rotor and the cylinder member during operation is large, and therefore, the difference in degree of thermal expansion between the screw rotor and the cylinder member is large. Accordingly, a space is formed and interference occurs between the cylinder member and the screw rotor. However, in the present invention, the cylinder member (25) is heated to reduce a temperature difference between the cylinder member (25) and the screw rotor (30), and reduce the difference in degree of thermal expansion between the cylinder member (25) and the screw rotor (30). As a result, it is possible to prevent the formation of space and the occurrence of interference between the cylinder member (25) and the screw rotor (30).

Further, since the heating groove (26) and the communication passage (52, 62) are connected together, the fluid flowing in the heating groove (26) can flow in the low pressure chamber (12). That is, the fluid in the high pressure space is made to flow into the low pressure space without flowing through the compression mechanism (20), thereby making it possible to reduce the pressure difference between the high pressure space and the low pressure space in the casing (10), and thus possible to reduce the screw rotor (30) and the gate rotor (40) from being rotated in a reverse direction. Accordingly, it is possible to prevent the pressure in the non-compression space of the compression mechanism (20) from being higher than the pressure of the fluid in the compression space with reliability. As a result, it is possible to prevent damage and breakage of the gate rotor (40) with reliability.

According to the fifth aspect of the present invention, the communication passage (62) is provided outside the casing (10). Thus, the fluid flowing in the high pressure chamber (11) is allowed to flow in the low pressure chamber (12) without providing the communication passage (62) in the casing (10). This makes it possible to form the communication passage more easily, compared to the case in which the communication passage is formed in the casing (10).

According to the sixth aspect of the present invention, the valve mechanism (53, 63) is opened when the compression mechanism (20) is stopped. Thus, even in the case of sudden halt of the compression mechanism (20), the fluid in the high pressure space is made to flow into the low pressure space without flowing through the compression mechanism (20), thereby making it possible to reduce a pressure difference between the high pressure space and the low pressure space in the casing (10), and prevent the screw rotor (30) and the gate rotor (40) from being rotated in a reverse direction. Accordingly, it is possible to prevent the pressure in the non-compression space of the compression mechanism (20) from being higher than the pressure of the fluid in the compression space with reliability. As a result, it is possible to prevent damage and breakage of the gate rotor (40) with reliability.

According to the seventh aspect of the present invention, the valve mechanism (53, 63) is opened when the screw rotor (30), etc., is rotated in a reverse direction. Thus, a pressure difference between the high pressure space and the low pressure space in the casing (10) can be reduced. It is therefore possible to prevent the screw rotor (30) and the gate rotor (40) from being rotated in a reverse direction. Accordingly, it is possible to prevent the pressure in the non-compression space of the compression mechanism (20) from being higher than the pressure of the fluid in the compression space. As a result, it is possible to prevent damage and breakage of the gate rotor (40) with reliability.

According to the eighth aspect of the present invention, the electric power regenerated by the DC motor (81) is accumulated. Thus, it is possible to open the valve mechanism (53, 63) when the electric power supply is stopped due to a power failure, etc. One of the problems when the electric power supply is stopped due to a power failure, etc., is that it is not possible to ensure the electric power for operating the valve mechanism (53, 63). However, according to the present invention, the valve mechanism (53, 63) can be opened even in such a situation, by utilizing the electric power regenerated at the time of rotation of the DC motor (81) in a reverse direction. Consequently, it is possible to prevent the screw rotor (30) from being rotated in a reverse direction.

DESCRIPTION OF EMBODIMENTS

An embodiment of the present invention will be described in detail below with reference to the drawings.

Figure 1:
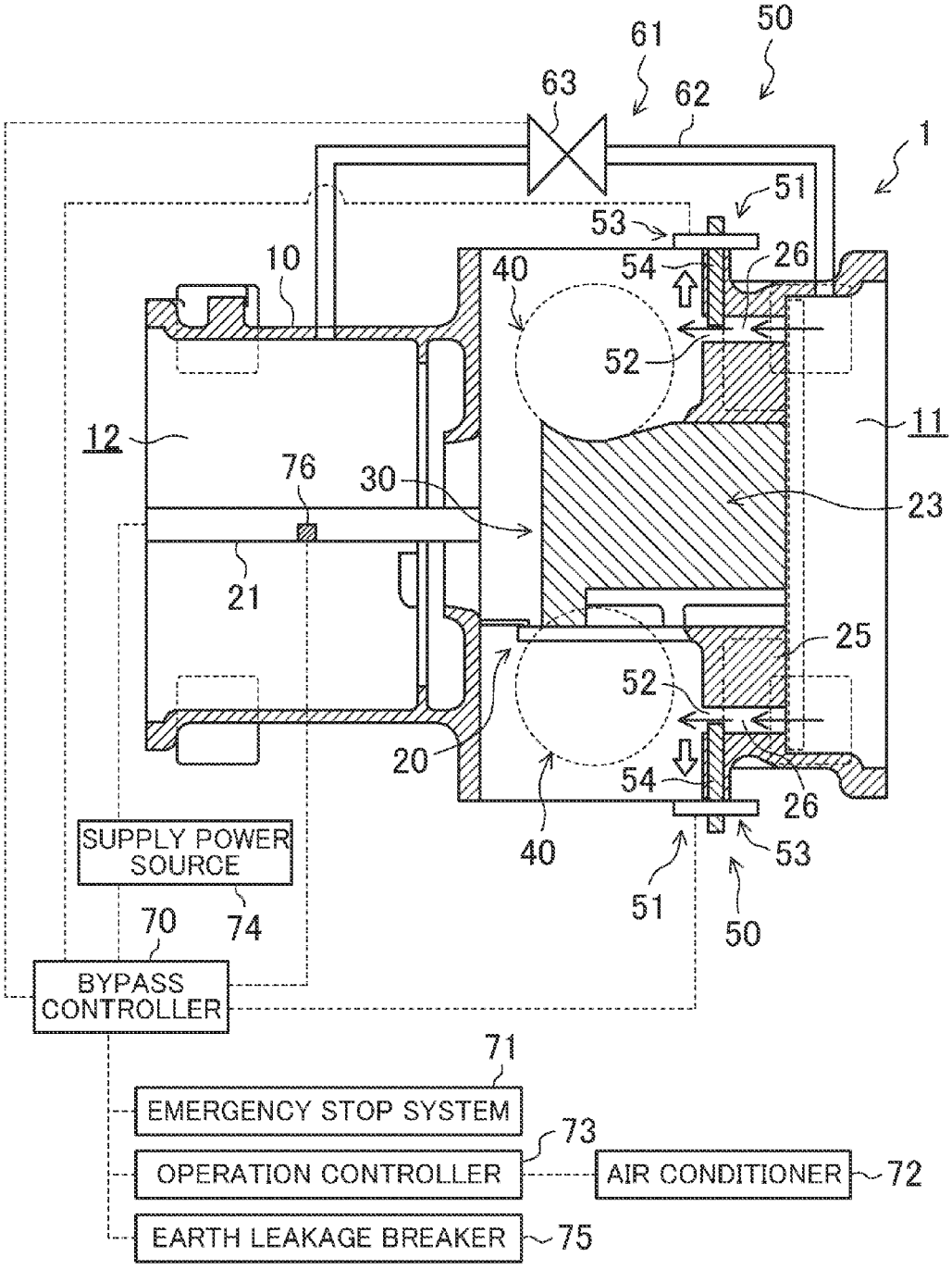
FIG. 1 is a schematic view of a screw compressor according to embodiment.

As shown in FIG. 1, a single screw compressor (1) (hereinafter referred to as a screw compressor (1)) of the present embodiment is used for refrigeration and air conditioning, and is provided in a refrigerant circuit, which performs a refrigeration cycle, to compress a refrigerant.

Figure 2:
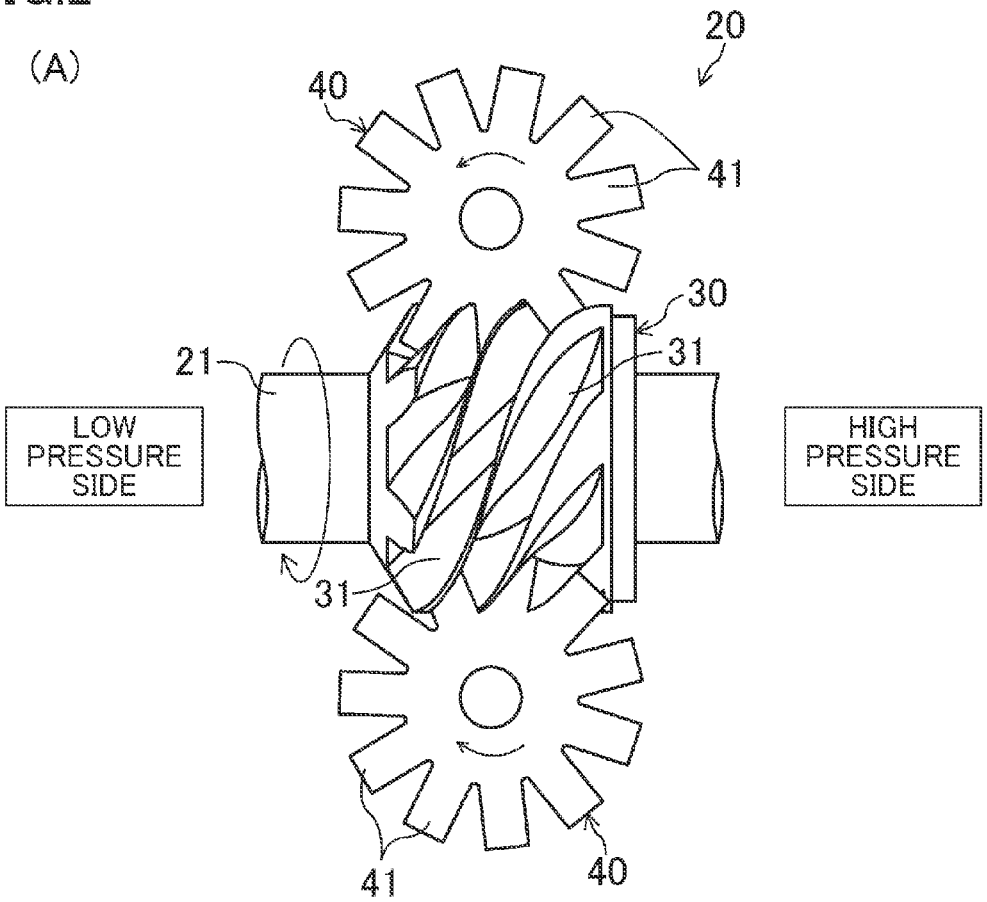
FIGS. 2(A) and 2(B) are oblique views of a screw rotor and gate rotors according to embodiment.
Figure 2:
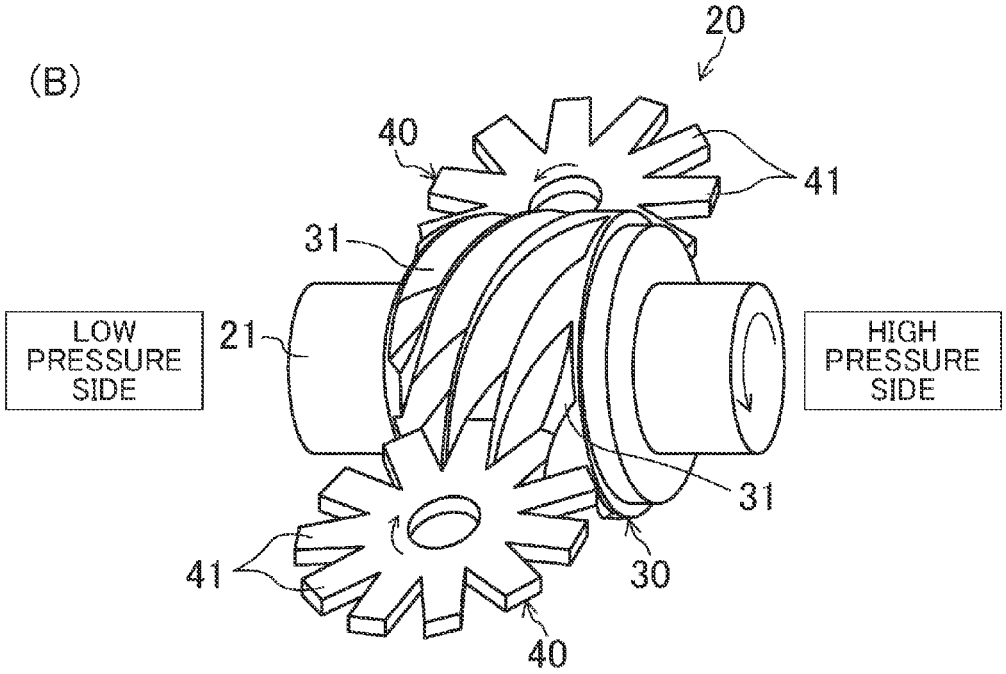

As shown in FIG. 1 and FIG. 2, the screw compressor (1) is hermetic. The screw compressor (1) includes a hollow, cylindrical casing (10) and a bypass mechanism (50).

The casing (10) accommodates a compression mechanism (20) for compressing a low pressure refrigerant at a central location in the casing (10). Further, a low pressure chamber (12) to which a low pressure gaseous refrigerant is supplied from an evaporator (not shown) of the refrigerant circuit, and which guides the low pressure gas to the compression mechanism (20), and a high pressure chamber (11) which is opposed to the low pressure chamber (12) with the compression mechanism (20) interposed therebetween, and to which a high pressure gaseous refrigerant discharged from the compression mechanism (20) flows, are provided in the casing (10). Although not shown, an electric motor is fixed in the casing (10), and the electric motor and the compression mechanism (20) are connected together by a drive shaft (21) which is an axis of rotation.

The compression mechanism (20) includes a cylinder (25) formed in the casing (10), one screw rotor (30) provided in the cylinder (25), and two (a pair of) gate rotors (40) which mesh with the screw rotor (30). The screw rotor (30) is attached to the drive shaft (21), and a key is provided to prevent rotation of the screw rotor (30) about the drive shaft (21).

The cylinder (25) is a member having a certain thickness, and is placed around the screw rotor (30) in the casing (10), and serves as a cylinder member according to the present invention. The cylinder (25) is attached so as to be located between a peripheral region of the screw rotor (30) and the inner wall surface of the casing (10). One side (i.e., the right end in FIG. 1) of the cylinder (25) faces the high pressure chamber (11), and the other side (i.e., the left end in FIG. 1) faces the low pressure chamber (12). That is, the inner space of the casing (10) is partitioned by the cylinder (25) into a space where the refrigerant pressure is high and a space where the refrigerant pressure is low.

The cylinder (25) is provided with grooves (26, 26) recessed from the surface on the high pressure space to the low pressure space. The cylinder (25) is heated when the refrigerant in the high pressure chamber (11) flows to the grooves (26, 26). When the cylinder (25) is heated, a temperature difference between the cylinder (25) and the screw rotor (30) is reduced. This means that the difference in degree of thermal expansion between the cylinder (25) and the screw rotor (30) is reduced. Therefore, it is possible to prevent the formation of space and the occurrence of interference between the cylinder (25) and the screw rotor (30) due to the difference in degree of thermal expansion between the cylinder (25) and the screw rotor (30) during operation of the screw compressor (1). The groove (26) corresponds to a heating groove according to the present invention.

As shown in FIG. 2, the screw rotor (30) includes a plurality of helical tooth grooves (31) (six helical grooves in the present embodiment) in the outer peripheral surface. The screw rotor (30) is rotatably fitted into the cylinder (25), and the outer peripheral surface of the tooth end is surrounded by the cylinder (25). Each of the gate rotors (40) is in the shape of a flat plate having a plurality of flat teeth (41) (eleven flat teeth in the present first embodiment) on the outer peripheral surface. The gate rotors (40) are placed outside the cylinder (25) symmetrically with respect to the screw rotor (30), and are arranged such that the axis of each of the gate rotors (40) is orthogonal to the axis of the screw rotor (30). The flat teeth (41) of the gate rotors (40) pass through part of the cylinder (25) and mesh with the tooth groove (31) of the screw rotor (30). The screw rotor (30) is made of metal, and the gate rotors (40) are made of resin. The screw rotor (30) and the gate rotors (40) will be described in detail later.

As shown in FIG. 1, each of the gate rotors (40) is placed in a gate rotor chamber (not shown) formed in the casing (10). A driven shaft (not shown) is an axis of rotation is connected to a central portion of the gate rotor (40). The driven shaft is rotatably supported by a bearing housing provided in the gate rotor chamber. This bearing housing supports the driven shaft via a ball bearing, and supports the gate rotor (40) on one side. Each of the gate rotor chambers communicates with the low pressure space (i.e., the low pressure chamber (12)).

In the compression mechanism (20), the space surrounded by the inner peripheral surface of the cylinder (25), the tooth groove (31) of the screw rotor (30), and the flat teeth (41) of the gate rotor (40) forms the compression chamber (23). The left end portion of the screw rotor (30) as shown in FIG. 1 and FIG. 2 is an inlet side, and the right end portion is a discharge side. The outer peripheral portion of the inlet side end of the screw rotor (30) is tapered. The tooth groove (31) of the screw rotor (30) is open toward the low pressure space (i.e., the low pressure chamber (12)) at the inlet side end, and this open area is an inlet of the compression mechanism (20).

In the compression mechanism (20), the flat teeth of the gate rotor (40) moves along the tooth groove (31) of the screw rotor (30) as the screw rotor (30) rotates, thereby repeating the operation in which the space in the compression chamber (23) is increased, and the operation in which the space in the compression chamber (23) is reduced. Accordingly, a suction phase, a compression phase, and a discharge phase of the refrigerant are sequentially performed.

Figure 3:
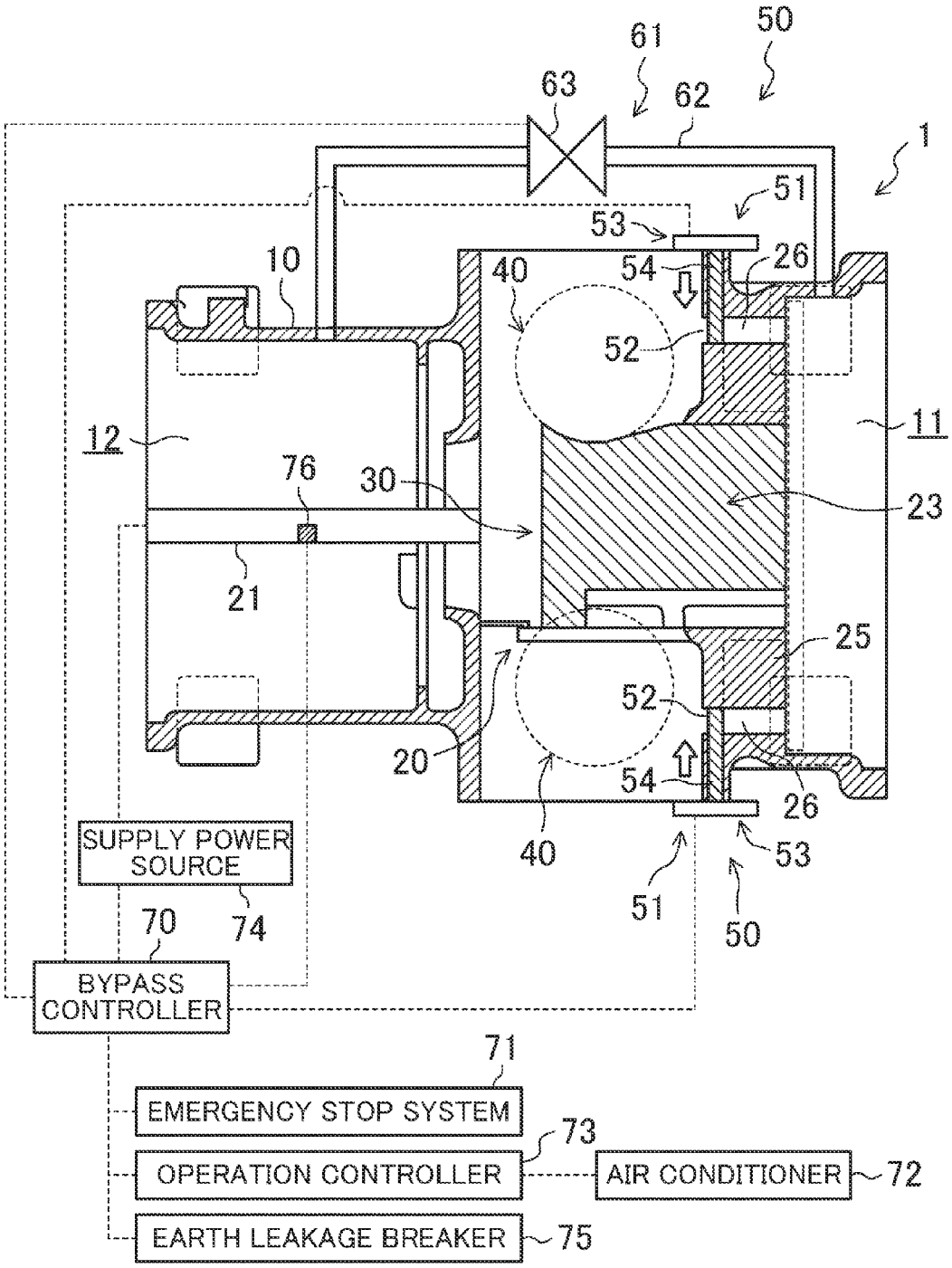
FIG. 3 is a schematic view of a screw compressor according to embodiment, with a bypass mechanism closed.

As shown in FIG. 1 and FIG. 3, the bypass mechanism (50) is for allowing the refrigerant flowing in the high pressure chamber (11) to flow into the low pressure chamber (12), and corresponds to a communication mechanism of the present invention. The bypass mechanism (50) includes an inside bypass mechanism (51) provided inside the casing (10), an outside bypass mechanism (61) provided outside the casing (10), a rotational frequency detection sensor (76) for detecting the rotational frequency of the screw rotor (30), and a bypass controller (70) connected to both of the bypass mechanisms (51, 61).

The inside bypass mechanism (51) includes an inside bypass passage (52) and an inner valve (53).

The inside bypass passage (52) is formed in the casing (10), and corresponds to a communication passage of the present invention. The inside bypass passage (52) is a passage through which the refrigerant flows. One end of the inside bypass passage (52) is connected to a bottom portion of a groove (26) of the cylinder (25) and communicates with the high pressure space (i.e., the high pressure chamber (11)), and the other end of the inside bypass passage (52) passes through the cylinder (25) and communicates with the low pressure space (i.e., the low pressure chamber (12)) of the casing (10).

The inner valve (53) is a solenoid valve for adjusting the amount of the refrigerant flowing in the inside bypass passage (52), and corresponds to a valve mechanism of the present invention. The inner valve (53) includes an inner valve body (54) and an opening and closing mechanism (not shown).

The inner valve body (54) is inserted in the inside bypass passage (52) from outside the casing (10), and is movable toward the inside and outside of the casing (10) by the opening and closing mechanism. Although not shown, the opening and closing mechanism includes a coiled spring, a coil, a plunger, a solenoid guide, and a solenoid coil. The inner valve (53) can close the inside bypass passage (52) by allowing the inner valve body (54) to move toward the inside of the casing (10), and can open the inside bypass passage (52) by allowing the inner valve body (54) to move toward the outside of the casing (10). When the inside bypass passage (52) is opened, the high pressure space (i.e., the high pressure chamber (11)) and the low pressure space (i.e., the high pressure chamber (12)) in the casing (10) communicate with each other.

The opening and closing mechanism is connected to the bypass controller (70), and the movement of the inner valve body (54) is controlled by the bypass controller (70).

The outside bypass mechanism (61) includes an outside bypass passage (62) and an outer valve (63).

The outside bypass passage (62) is formed outside the casing (10), and corresponds to a communication passage of the present invention. The outside bypass passage (62) is made of a hollow, tubular pipe member. One end of the outside bypass passage (62) is inserted into a space in the casing (10) where the high pressure space (i.e., the high pressure chamber (11)) is formed, and the other end of the outside bypass passage (62) is inserted into a space in the casing (10) where the low pressure space (i.e., the low pressure chamber (12)) is formed.

The outer valve (63) is a solenoid valve provided to the outside bypass passage (62), and corresponds to a valve mechanism of the present invention. The outer valve (63) is a solenoid valve capable of being opened and closed, and is provided substantially in a middle of the outside bypass passage (62). The outside bypass passage (62) is closed by closing the outer valve (63). The outside bypass passage (62) is opened by opening the outer valve (63). When the outside bypass passage (62) is opened, the high pressure space (i.e., the high pressure chamber (11)) and the low pressure space (i.e., the low pressure chamber (12)) in the casing (10) communicate with each other.

The outer valve (63) is connected to the bypass controller (70), and the opening and closing operations of the outer valve (63) are controlled by the bypass controller (70).

The rotational frequency detection sensor (76) is for detecting the rotational frequency of the screw rotor (30), and corresponds to a rotational direction detector of the present invention. The rotational frequency detection sensor (76) is attached to the drive shaft (21) to detect the rotational frequency of the drive shaft. The rotational frequency detection sensor (76) is connected to the bypass controller (70), and sends data about the detected rotational frequency of the screw rotor (30) to the bypass controller (70). That is, the rotational frequency detection sensor (76) detects the direction of rotation of the screw rotor (30) by detecting the rotational frequency of the screw rotor (30).

The bypass controller (70) is for controlling the opening and closing operations of the inner valve (53) and the outer valve (63), and corresponds to first and second valve controllers of the present invention. The bypass controller (70) is configured to close the inner valve (53) and the outer valve (63) when predetermined conditions described below are satisfied.

Figure 4:
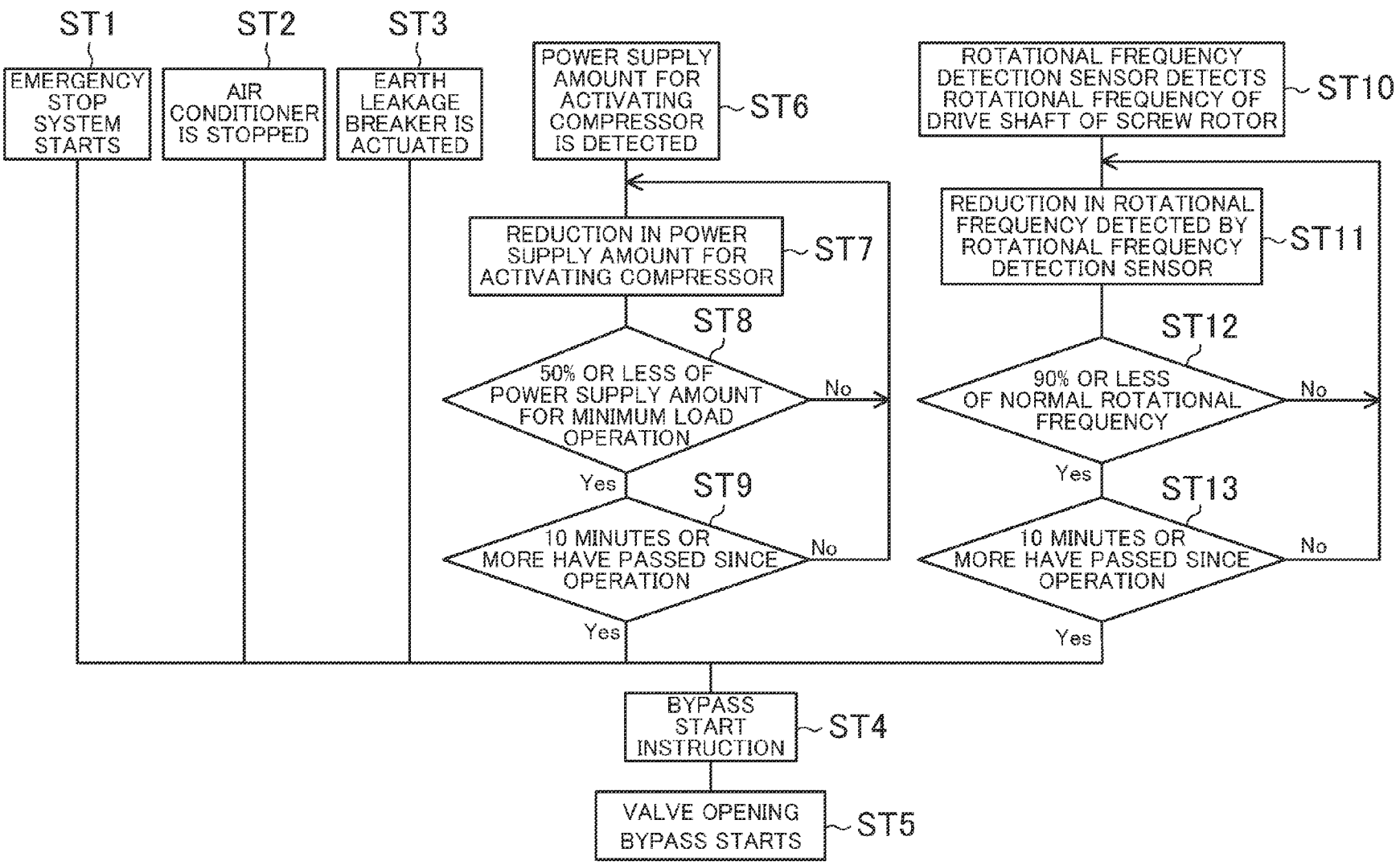
FIG. 4 is a flowchart which shows operation of a bypass mechanism according to embodiment.
Figure 5:
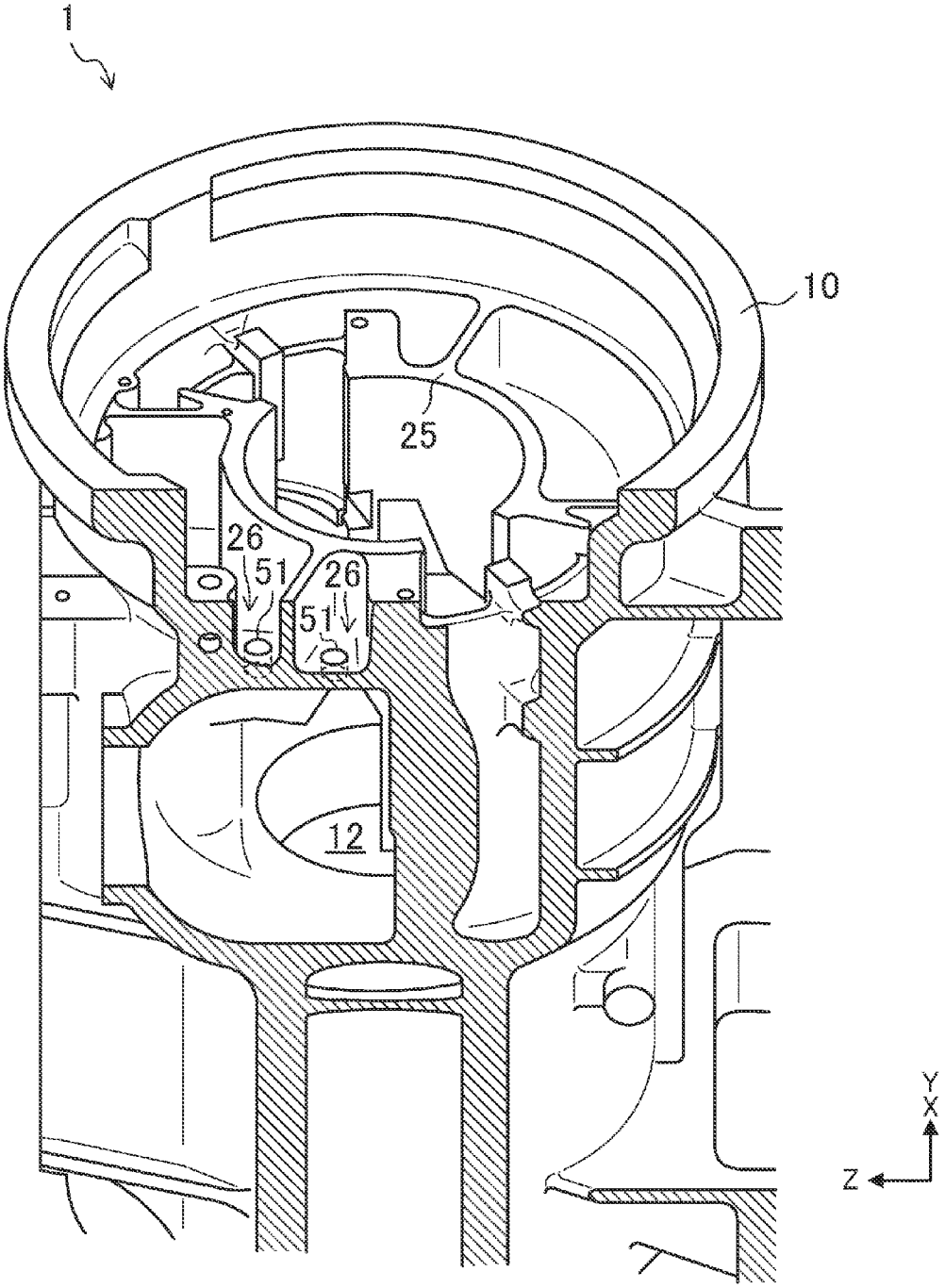
FIG. 5 is a schematic cross-sectional view of a casing as an example bypass mechanism according to another embodiment.
Figure 6:
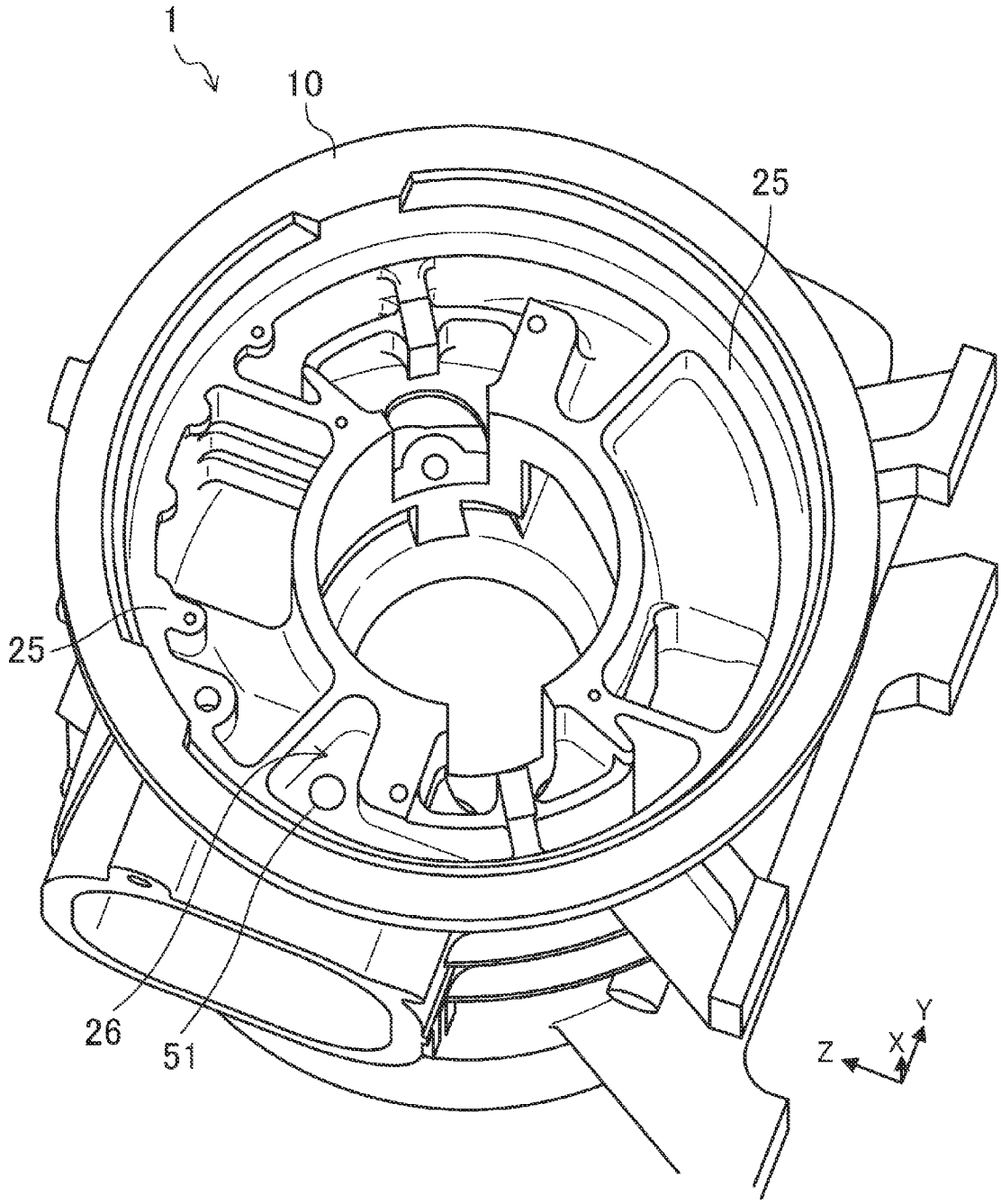
FIG. 6 is a schematic oblique view of a casing as an example bypass mechanism according to another embodiment.
Figure 7:
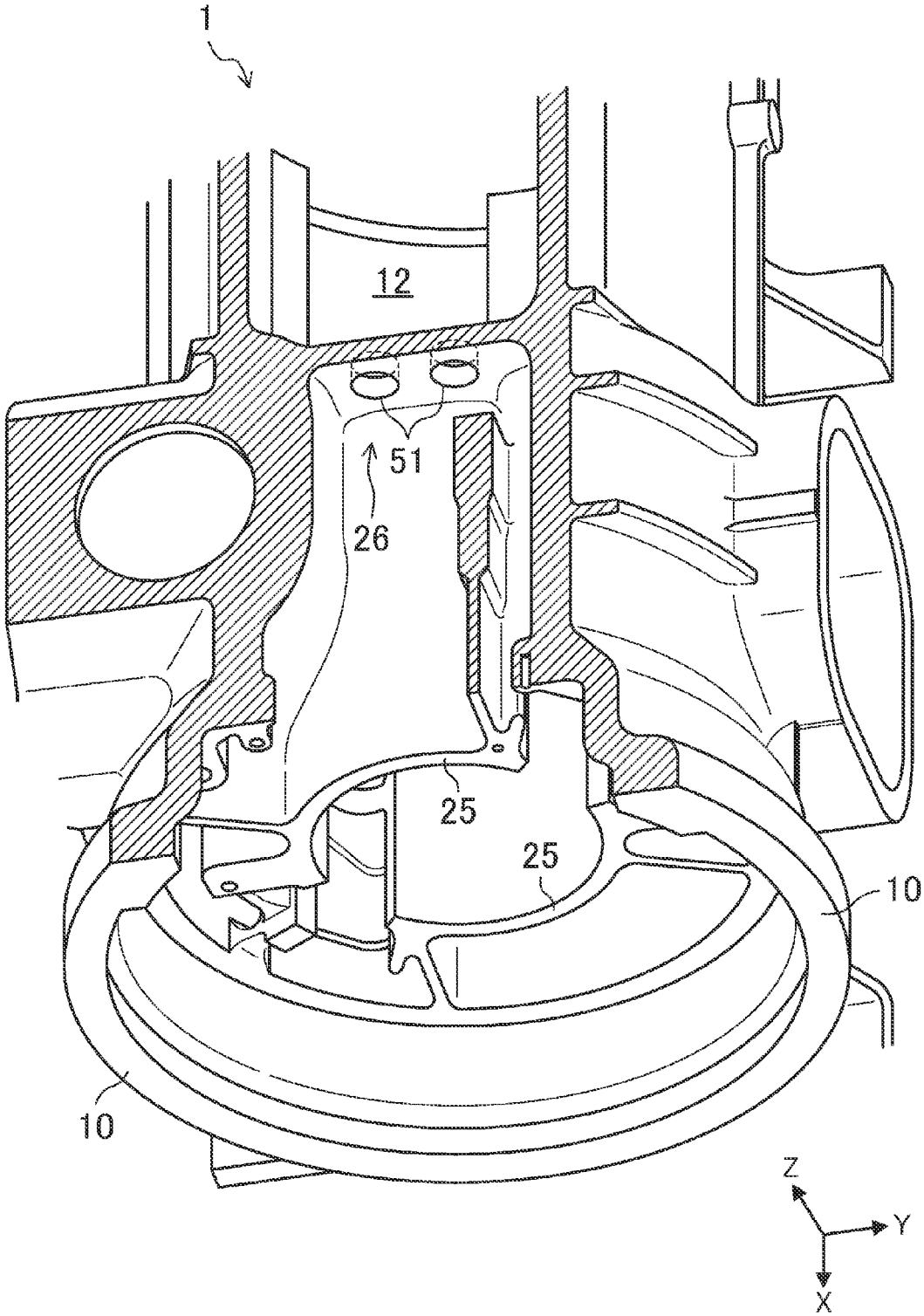
FIG. 7 is a schematic cross-sectional view of a casing as an example bypass mechanism according to another embodiment.
Figure 8:
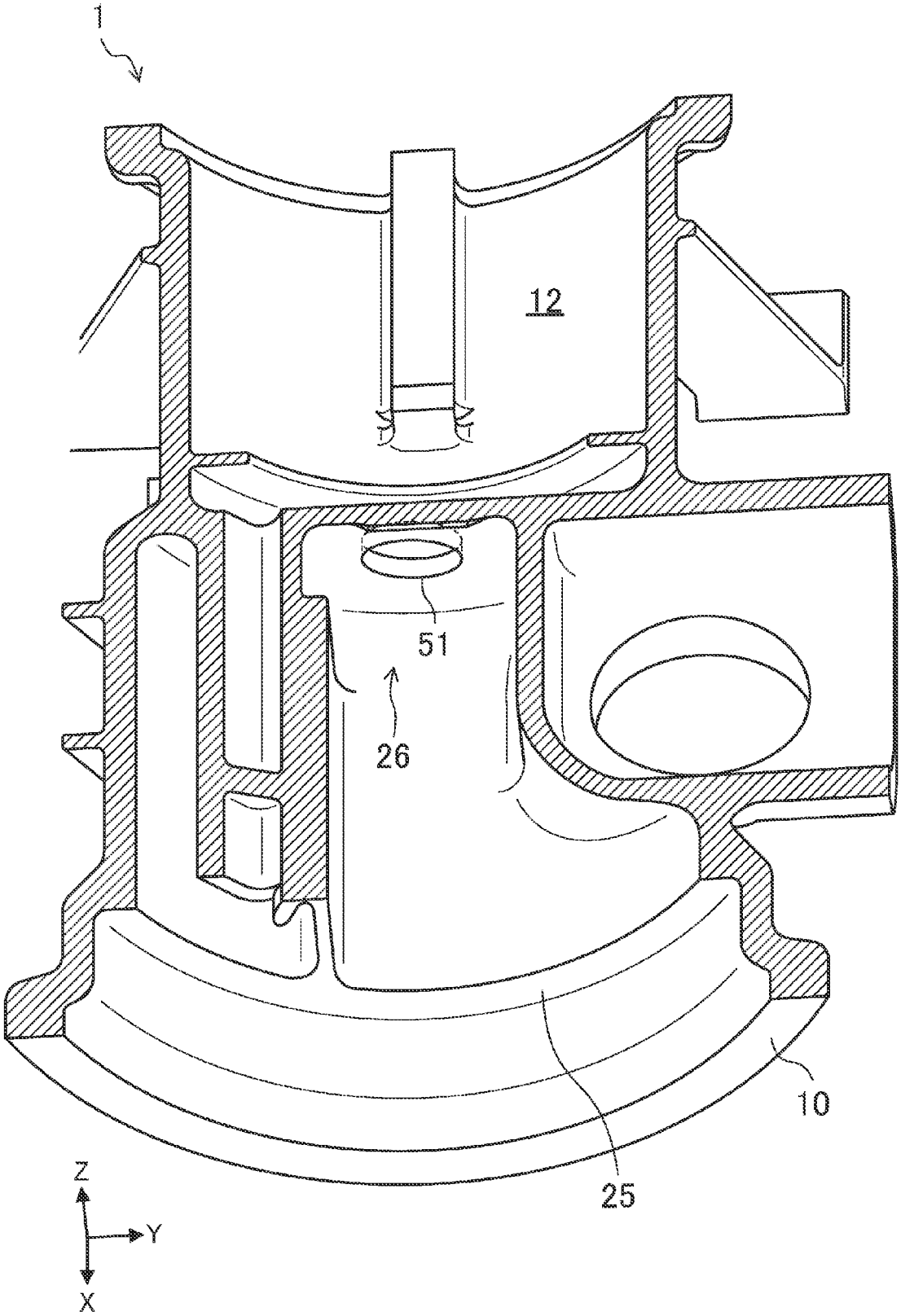
FIG. 8 is a schematic cross-sectional view of a casing as an example bypass mechanism according to another embodiment.
Figure 9:
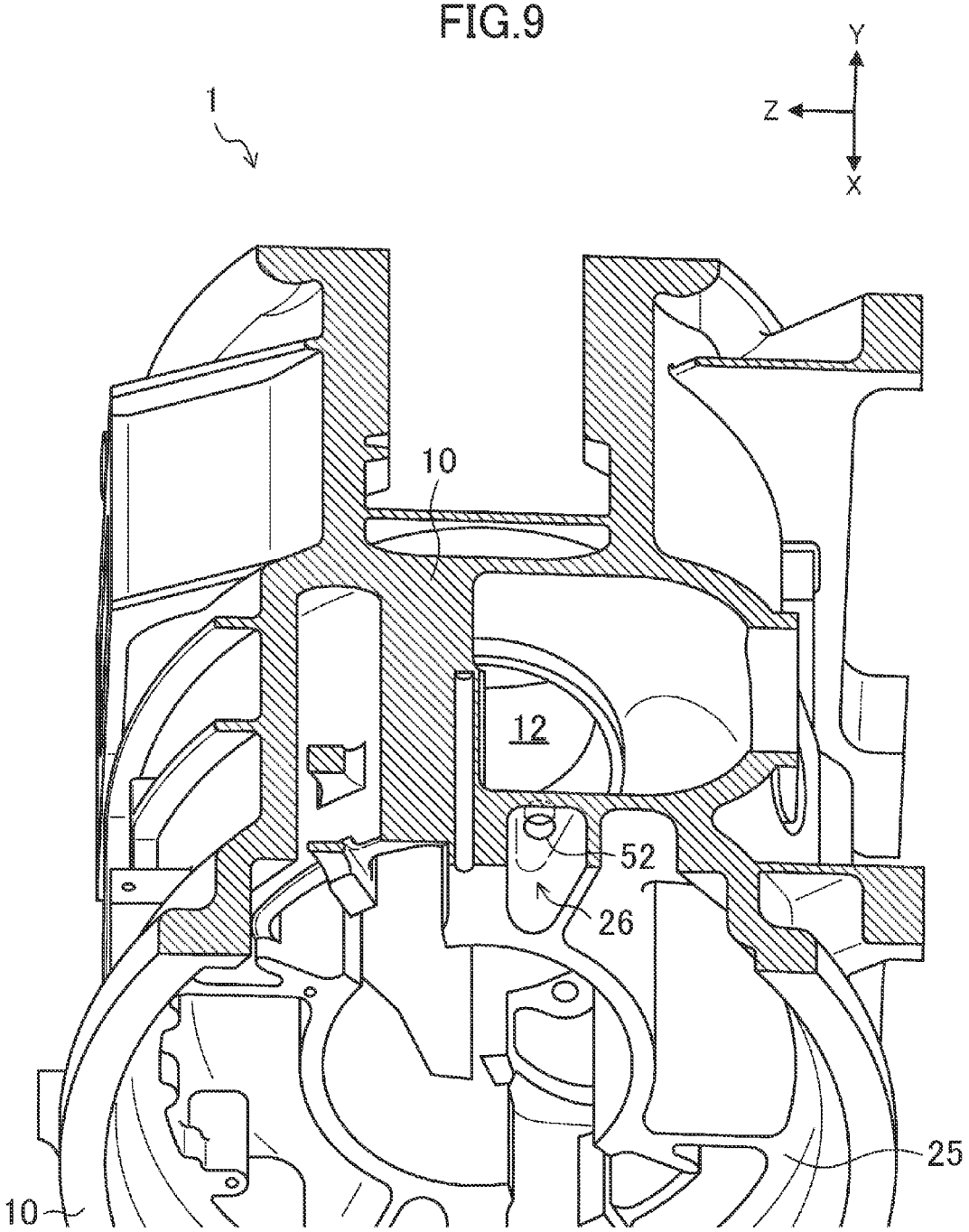
FIG. 9 is a schematic cross-sectional view of a casing as an example bypass mechanism according to another embodiment.

Specifically, as shown in FIG. 1 and FIG. 4, the bypass controller (70) is connected to the inner valve (53) and the outer valve (63), and connected to a supply power source (74) for actuating the screw compressor (1), an operation controller (73) for controlling the operation of an air conditioner (72), an earth leakage breaker (75), an emergency stop system (71) for the screw compressor (1), and the rotational frequency detection sensor (76).

Working Mechanism

Next, the working mechanism of the single screw compressor (1) will be described.

When the electric motor of the single screw compressor (1) is actuated, the screw rotor (30) is rotated as the drive shaft (21) rotates. The gate rotors (40) are also rotated simultaneously with the rotation of the screw rotor (30), and the compression mechanism (20) repeats a suction phase, a compression phase, and a discharge phase.

In the compression mechanism (20), the capacity of the screw compressor (1) is increased, and thereafter decreased, with the movement of the tooth groove (31) (i.e., the movement of the flat teeth (41)) as the screw rotor (30) rotates. During a period when the capacity of the compression chamber (23) is increased, a low pressure gaseous refrigerant in the low pressure space (i.e., the low pressure chamber (12)) is suctioned into the compression chamber (23) through the inlet (i.e., the suction phase). As the screw rotor (30) is further rotated, the flat teeth (41) of the gate rotor (40) comes to partition the compression chamber (23), which leads to an end of the increase in the capacity of the compression chamber (23) and a beginning of the reduction in the capacity of the compression chamber (23). During a period when the capacity of the compression chamber (23) is decreased, the suctioned refrigerant is compressed (i.e., the compression phase). The compression chamber (23) moves as the screw rotor (30) is further rotated, and is open at the outlet in the end. When the discharge side end of the compression chamber (23) is open as described, a high pressure gaseous refrigerant is discharged from the compression chamber (23) to the high pressure space (i.e., the high pressure chamber (11)) (i.e., the discharge phase).

Operation of Bypass Mechanism

Operations of the inner valve (53) and the outer valve (63) during a time when the operation of the compression mechanism (20) is halted will be described. In the screw compressor (1) of the present embodiment, the bypass controller (70) opens the inner valve (53) and the outer valve (63) when predetermined conditions (i.e., steps shown in FIG. 4) are satisfied.

Specifically, the bypass controller (70) receives an actuation signal from the emergency stop system (71), an operation signal from the earth leakage breaker (75), and a signal for halting the air conditioner (72) from the operation controller (73). The bypass controller (70) also receives data about an amount of power supplied from the supply power source (74) to the screw compressor (1). The bypass controller (70) further receives data about the rotational frequency of the screw rotor (30) from the rotational frequency detection sensor (76).

As shown in FIG. 4, the bypass controller (70) determines that the compression mechanism (20) is halted and moves to ST4 when the emergency stop system (71) starts in ST1, when the operation controller (73) stops the air conditioner (72) in ST2, and when the earth leakage breaker (75) is actuated in ST3.

Further, the bypass controller (70) detects the amount of power supplied from the supply power source (74) to the screw compressor (1) in ST6. Then, a reduction in the amount of power supply is detected in ST7, and if it is detected in ST8 that the amount of power supply is half (50%) or less of the amount of power supply during a minimum load operation of the air conditioner (72), the bypass controller (70) moves to ST9. If it is detected that the amount of power supply is more than half (50%) the amount of power supply during a minimum load operation of the air conditioner (72), the bypass controller (70) returns to ST7 again. Then, the bypass controller (70) moves to ST4 if ten minutes have passed since the actuation of the screw compressor (1) in ST9, and returns to ST7 again if ten minutes have not passed since the actuation of the screw compressor (1).

Further, the rotational frequency detection sensor (76) detects the rotational frequency of the drive shaft (21) of the screw rotor (30) in ST10, and detects a reduction in the detected rotational frequency in ST11. The bypass controller (70) moves to ST13 if the rotational frequency is 90% or less of the rotational frequency of the screw rotor (30) in a normal operation in sT12. The bypass controller (70) returns to ST11 again if the rotational frequency is more than 90% of the rotational frequency of the screw rotor (30) in a normal operation. Then, in ST13, the bypass controller (70) moves to ST4 if ten minutes have passed since the actuation of the screw compressor (1), and returns to ST11 again if ten minutes have not passed since the activation of the screw compressor (1).

Then, the bypass controller (70) outputs a bypass start instruction in ST4, and opens the inner valve (53) and the outer valve (63) in ST5. When the two valves (53, 63) are open, the inside bypass passage (52) and the outside bypass passage (62) communicate with each other, and the refrigerant flowing in the high pressure chamber (11) passes through the inside bypass passage (52) and the outside bypass passage (62) to flow into the low pressure chamber (12). Accordingly, the pressure of the refrigerant in the low pressure chamber (12) is increased, and thus, the difference between the pressure of the refrigerant in the high pressure chamber (11) and the pressure of the refrigerant in the low pressure chamber (12) is reduced. If the difference between the pressure of the refrigerant in the high pressure chamber (11) and the pressure of the refrigerant in the low pressure chamber (12) is reduced, the refrigerant in the high pressure chamber (11) does not flow into the low pressure chamber (12) through the compression mechanism (20). Thus, the screw rotor (30) and the gate rotors (40) of the compression mechanism (20) are prevented from being rotated in a reverse direction.

The bypass controller (70) may be connected to a device such as a temperature protection device like a thermistor, etc., and open the inner valve and the outer valve (63) when the device is activated.

Advantages of the Embodiment

According to the present embodiment, the provision of the inside bypass passage (52), the inner valve (53), the outside bypass passage (62), and the outer valve (63) allows the refrigerant in the high pressure chamber (11) to flow into the low pressure chamber (12) without flowing through the compression mechanism (20). In the conventional screw compressor, in the event, for example, of sudden halt of the compression mechanism, the screw rotor and the gate rotors are rotated in a reverse direction due to the difference between the pressures of the fluids in the high pressure space and the low pressure space in the casing, and the gate rotors are damaged. Even in such a case, according to the screw compressor (1) of the present embodiment, the refrigerant in the high pressure chamber (11) is made to flow into the low pressure chamber (12) without flowing through the compression mechanism (20), thereby making it possible to prevent the screw rotor (30) and the gate rotors (40) from being rotated in a reverse direction, and reduce a pressure difference between the high pressure chamber (11) and the low pressure chamber (12) of the casing (10).

Further, the bypass controller (70) is provided to open the inner valve (53) and the outer valve (63) when the emergency stop system (71) starts, when the operation controller (73) stops the air conditioner (72), when earth leakage breaker (75) is actuated, and when the amount of power supplied from the supply power source (74) to the screw compressor (1) is reduced. Thus, even in the case of sudden halt of the compression mechanism (20), the fluid in the high pressure space is made to flow into the low pressure space without flowing through the compression mechanism (20), thereby making it possible to prevent the screw rotor (30) and the gate rotors (40) from being rotated in a reverse direction, and reduce a pressure difference between the high pressure chamber (11) and the low pressure chamber (12) of the casing (10).

Further, the rotational frequency detection sensor (76) is provided so that the inner valve (53) and the outer valve (63) are opened if the screw rotor (30) and the gate rotors (40) are rotated in a reverse direction. It is therefore possible to prevent the screw rotor (30) and the gate rotors (40) from being rotated in a reverse direction, and possible to reduce the pressure difference between the high pressure chamber (11) and the low pressure chamber (12) of the casing (10).

Moreover, since both of the inner valve (53) and the outer valve (63) are provided, it is possible to reduce the pressure difference between the high pressure chamber (11) and the low pressure chamber (12) of the casing (10) in a short time.

With the above structure, it is possible to prevent the situation where the pressure of the fluid in the non-compression space is larger than the pressure of the fluid in the compression space of the compression chamber 23). As a result, it is possible to prevent damage and breakage of the gate rotors (40) with reliability.

Moreover, since the grooves (26, 26) through which the high pressure refrigerant flowing in the high pressure chamber (11) passes are provided, it is possible to heat the cylinder (25) by the high pressure refrigerant flowing in the grooves (26, 26). Thus, a temperature difference between the cylinder (25) and the screw rotor (30) can be reduced. In the conventional screw compressor, a temperature difference between the screw rotor and the cylinder during operation is large, and therefore, the difference in degree of thermal expansion between the screw rotor the cylinder is large. Accordingly, a space is formed and interference occurs between the cylinder and the screw rotor. However, in the present embodiment, the cylinder (25) is heated to reduce a temperature difference between the cylinder (25) and the screw rotor (30), and reduce the difference in degree of thermal expansion between the cylinder (25) and the screw rotor (30). As a result, it is possible to prevent the formation of space and the occurrence of interference between the cylinder (25) and the screw rotor (30).

Variation of the Embodiment

Next, a variation of the above embodiment will be described. In this variation, the structure of the electric motor is different from the structure of the electric motor of the above embodiment.

Figure 10:
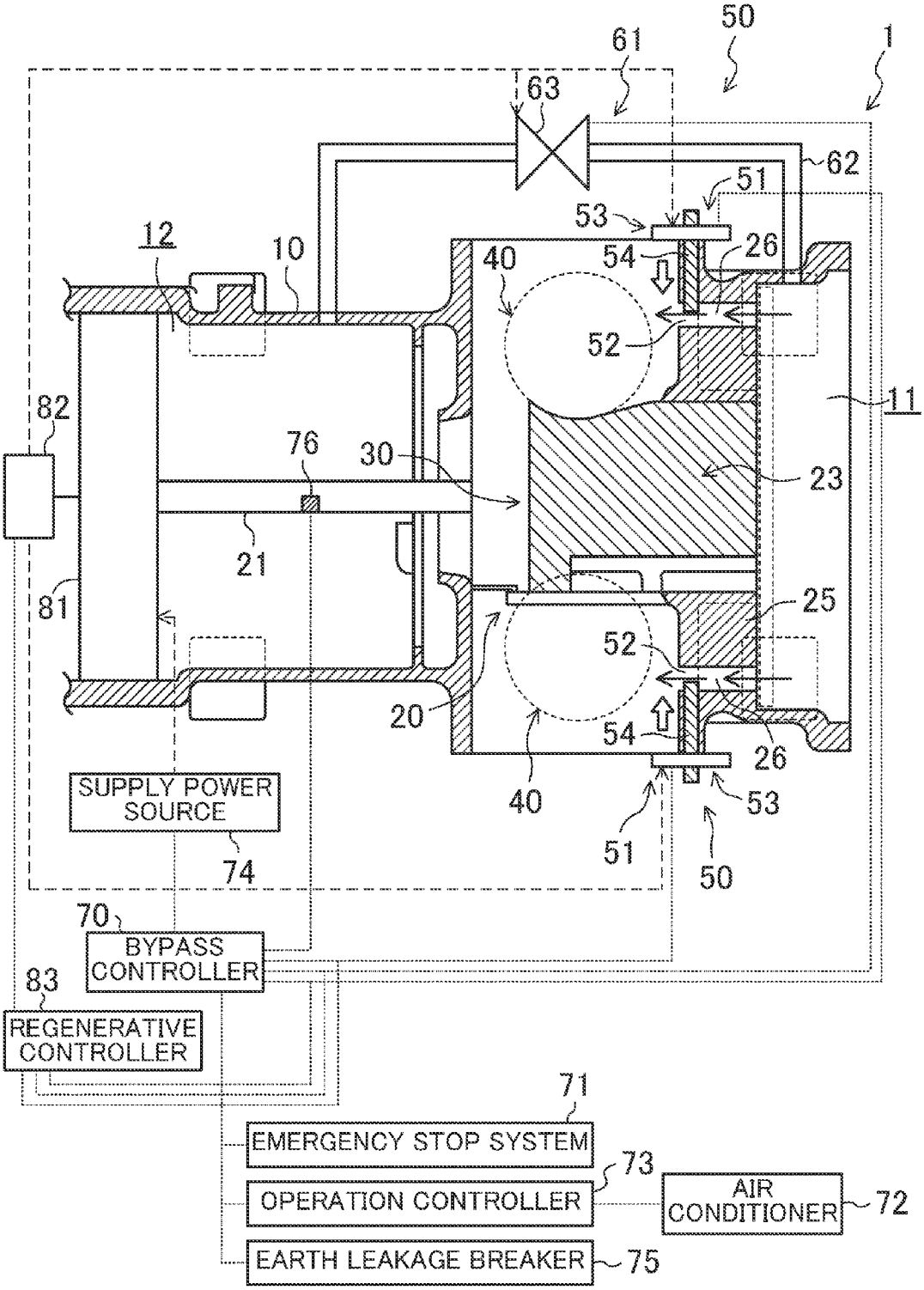
FIG. 10 is a schematic view of a screw compressor according to a variation of embodiment.
Figure 11:
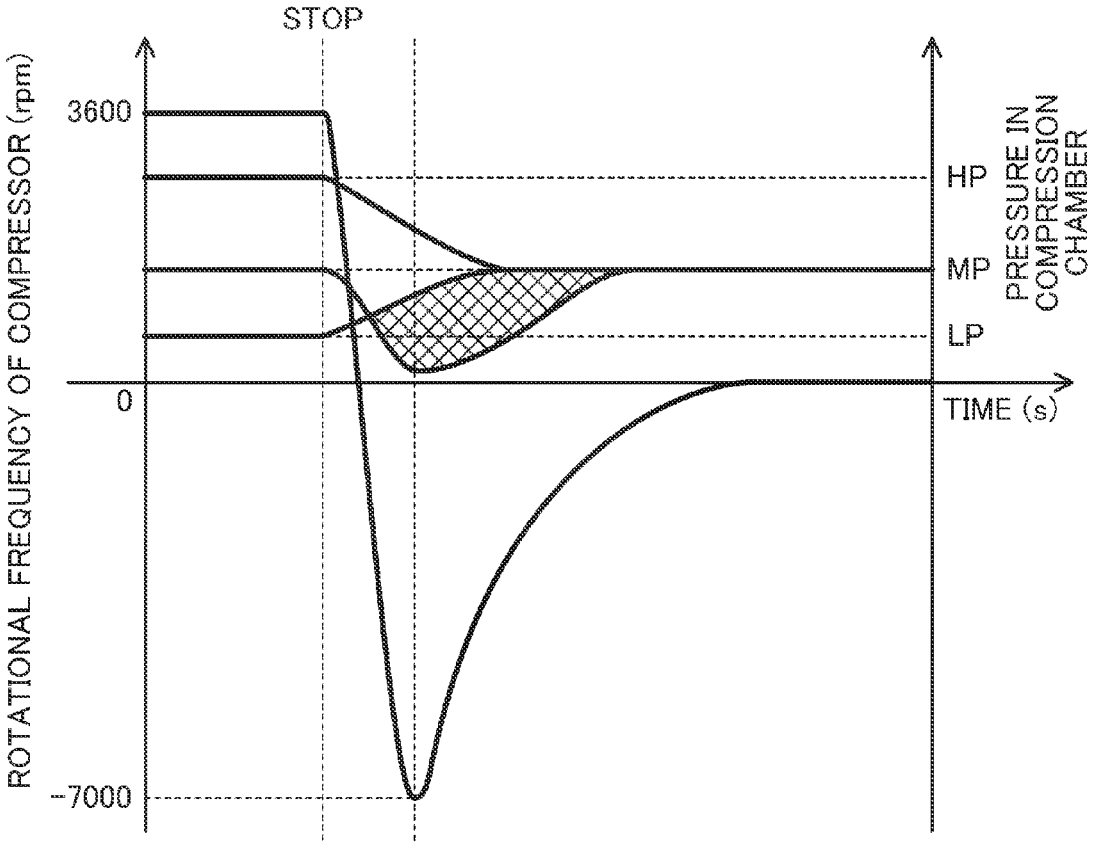
FIG. 11 is a graph showing a relationship between the rotational frequency and time, and a relationship between the pressure in a compression chamber and time, according to a conventional screw compressor.
Figure 12:
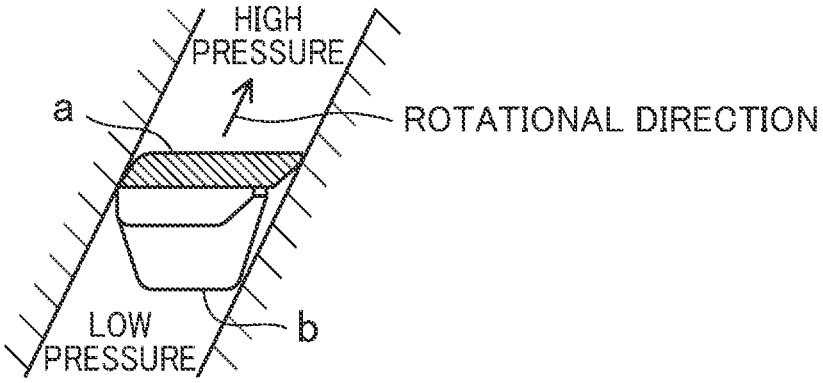
FIG. 12 is a schematic view showing a state of a gate rotor of a conventional screw compressor at a time of normal operation.
Figure 13:
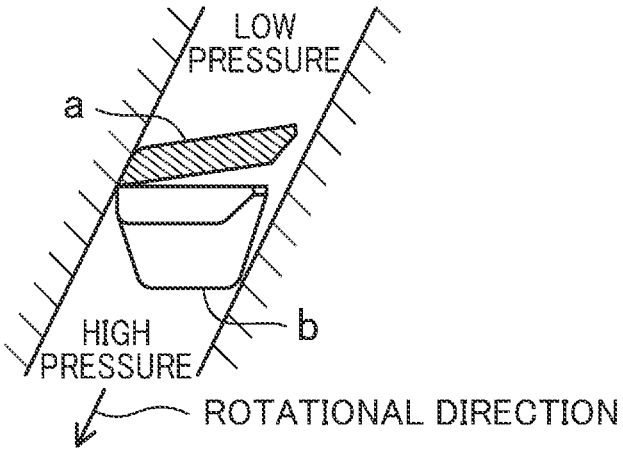
FIG. 13 is a schematic view showing a state of a gate rotor of a conventional screw compressor at a time of sudden halt, etc.

Specifically, as shown in FIG. 10, a screw compressor (1) of the present variation includes an electric motor (81), a battery (82), and a regenerative controller (83) in addition to the elements of the screw compressor (1) according to the above embodiment.

The electric motor (81) is a brushless DC (direct current) motor having a stator and a rotor. The electric motor (81) corresponds to a DC motor of the present invention. The stator is located at a lower position relative to the compression mechanism (20), and is fixed to the body of the casing (10). A drive shaft (21) which is rotated together with the rotor is connected to the rotor. The battery (82) is for storing the electric power generated by the electric motor (81), and corresponds to an accumulator of the present invention.

The regenerative controller (83) utilizes the electric power in the battery (82) to control the opening and closing of the inner valve (53) and the outer valve (63), and corresponds to a third valve controller of the present invention.

Next, the operation of the bypass mechanism (50) of the present variation will be described. The present variation is intended for a situation in which electric power supply to the screw compressor (1) is stopped, for example, due to a power failure, etc. In other words, the present variation is intended for a situation in which if electric power supply is stopped, the screw rotor (30) is rotated in a reverse direction due to a pressure difference of the refrigerant, and the inner valve (53) and the outer valve (63) cannot be operated due to electric power shortage.

Specifically, the screw compressor (1) suddenly stops if a power failure, etc., occurs. Then, the screw rotor is rotated in a reverse direction due to a pressure difference of the refrigerant. The electric motor (81) functions as an electric generator at this time, and the regenerated electric power is accumulated in the battery (82). The regenerative controller (83) utilizes the electric power in the battery (82) to operate the inner valve (53) and the outer valve (63) and open the two valves (53, 63).

When the inner valve (53) is opened (i.e., when the inner valve body (54) is moved toward the outside of the casing (10)), the inside bypass passage (52) is open. When the inside bypass passage (52) is open, the high pressure space (i.e., the high pressure chamber (11)) and the low pressure space (i.e., the low pressure chamber (12)) of the casing (10) communicate with each other. When the outer valve (63) is opened, the outside bypass passage (62) is open. When the outside bypass passage (62) is open, the high pressure space (i.e., the high pressure chamber (11)) and the low pressure space (i.e., the low pressure chamber (12)) of the casing (10) communicate with each other.

Accordingly, the pressure of the refrigerant in the low pressure chamber (12) is increased, and thus, the difference between the pressure of the refrigerant in the high pressure chamber (11) and the pressure of the refrigerant in the low pressure chamber (12) is reduced. If the difference between the pressure of the refrigerant in the high pressure chamber (11) and the pressure of the refrigerant in the low pressure chamber (12) is reduced, the refrigerant in the high pressure chamber (11) does not flow into the low pressure chamber (12) through the compression mechanism (20). Thus, the screw rotor (30) and the gate rotors (40) are prevented from being rotated in a reverse direction.

According to the present variation, the electric power regenerated by the electric motor (81) is accumulated. Thus, it is possible to open the inner valve (53) and the outer valve (63) even if electric power supply is stopped due to a power failure, etc. One of the problems when the electric power supply is stopped due to a power failure, etc., is that it is not possible to ensure the electric power for operating the inner valve (53) and the outer valve (63). However, according to the present variation, the two valves (53, 63) can be opened even in such a situation, by utilizing the electric power regenerated at the time of rotation of the electric motor (81) in a reverse direction. Consequently, it is possible to prevent the screw rotor (30) from being rotated in a reverse direction. As a result, it is possible to prevent damage and breakage of the gate rotor (40) with reliability. The other structures, operations and advantages are similar to the case in the above embodiment.

Other Embodiments

The present invention may have the following structures in the above embodiment.

According to the present embodiment, the rotational frequency detection sensor (76) is attached to the drive shaft (21) of the screw rotor (30), but the rotational frequency detection sensor (76) may be attached to the screw rotor (30), or may be attached to the driven shaft of the gate rotor (40).

According to the present embodiment, the screw compressor (1) includes both of the inside bypass mechanism (51) and the outside bypass mechanism (61) as the bypass mechanism (50), but the bypass mechanism (50) may be configured to include one of the inside bypass mechanism (51) or the outside bypass mechanism (61).

The inside bypass passage (52) formed in the cylinder (25) may be formed in grooves at various locations of the cylinder (25) as shown in FIG. 5 to FIG. 9, other than in the grooves (26, 26) described in the above embodiment.

The foregoing embodiments are merely preferred examples in nature, and are not intended to limit the scope, applications, and use of the invention.

INDUSTRIAL APPLICABILITY

As described above, the present invention relates to a screw compressor, and is particularly useful as a measure for preventing damage and breakage of a gate rotor.

What is claimed is:

1. A screw compressor, comprising:

a casing; and a compression mechanism accommodated in the casing, the compression mechanism having a screw rotor, a gate rotor with a flat plate shape, a rotational axis of gate rotor being orthogonal to a rotational axis of the screw rotor, and a communication mechanism arranged to communicate a high pressure space and a low pressure space in the casing, the casing including a low pressure chamber from which a fluid at low pressure is suctioned into the compression mechanism, and a high pressure chamber to which the fluid compressed by the compression mechanism flows, and the communication mechanism including a communication passage connecting the high pressure chamber and the low pressure chamber, a valve mechanism configured to adjust an amount of fluid flowing in the communication passage, a rotational frequency detection sensor configured to detect a rotational frequency of the screw rotor, and a valve controller configured to open the valve mechanism when the rotational frequency of the screw rotor detected by the rotational frequency detection sensor is less than or equal to a predetermined value.

2. The screw compressor of claim 1, wherein the communication passage is provided in the casing.

3. The screw compressor of claim 2, wherein the casing includes a cylinder member surrounding the screw rotor, and a heating groove formed in the cylinder member to guide the fluid in the high pressure chamber to the cylinder member, and an end of the communication passage connected to the high pressure chamber communicates with the heating groove.

4. The screw compressor of claim 1, wherein the communication passage is provided outside the casing.

5. A screw compressor, comprising:

a casing;

a compression mechanism accommodated in the casing, the compression mechanism having a screw rotor, a gate rotor with a flat plate shape, a rotational axis of gate rotor being orthogonal to a rotational axis of the screw rotor, and a communication mechanism arranged to communicate a high pressure space and a low pressure space in the casing;

a DC motor configured to rotate the compression mechanism;

an accumulator configured to accumulate regenerated electric power of the DC motor which is generated by the screw rotor rotating in a reverse direction after stop of electric power supply to the screw compressor; and a valve controller, the casing including a low pressure chamber from which a fluid at low pressure is suctioned into the compression mechanism, and a high pressure chamber to which the fluid compressed by the compression mechanism flows, the communication mechanism including a communication passage connecting the high pressure chamber and the low pressure chamber, and a valve mechanism configured to adjust an amount of fluid flowing in the communication passage, the valve controller being configured to operate the valve mechanism using the electric power accumulated in the accumulator after the stop of the electric power supply to the screw compressor.

* * * * *